United States Patent [19]

Hertell

[11] Patent Number: 4,780,070

[45] Date of Patent: Oct. 25, 1988

[54] GEAR PUMP HAVING MULTIPLE OUTPUTS

[75] Inventor: Siegfried Hertell, Radevormwald, Fed. Rep. of Germany

[73] Assignee: Barmag AG, Remscheid, Fed. Rep. of Germany

[21] Appl. No.: 54,579

[22] Filed: May 27, 1987

Related U.S. Application Data

[62] Division of Ser. No. 701,638, Feb. 14, 1985, Pat. No. 4,674,964.

[30] Foreign Application Priority Data

| | | | |
|---|---|---|---|
| Feb. 15, 1984 | [DE] | Fed. Rep. of Germany | 3405341 |
| Mar. 2, 1984 | [DE] | Fed. Rep. of Germany | 3407771 |
| May 8, 1984 | [DE] | Fed. Rep. of Germany | 3416916 |
| Jun. 28, 1984 | [DE] | Fed. Rep. of Germany | 3423794 |

[51] Int. Cl.[4] ..... F04C 2/10

[52] U.S. Cl. ..... 418/61.1; 418/183

[58] Field of Search ..... 418/61 R, 183

[56] References Cited

U.S. PATENT DOCUMENTS

| | | | |
|---|---|---|---|
| 1,183,309 | 5/1916 | Loftus | 418/61 R |
| 1,922,423 | 8/1933 | Ericson | 418/60 |
| 2,912,937 | 11/1959 | Insley | 418/61 R |
| 3,236,187 | 2/1966 | Eyer | 418/61 R |
| 3,606,600 | 9/1971 | Pollman | 418/61 R |
| 3,865,086 | 2/1975 | Lee | 418/61 R |
| 3,966,367 | 6/1976 | Erickson | 418/58 |
| 4,008,982 | 2/1977 | Traut | 418/60 |

FOREIGN PATENT DOCUMENTS

| | | | |
|---|---|---|---|
| 871692 | 2/1953 | Fed. Rep. of Germany . | |
| 855322 | 2/1940 | France | 418/61 R |
| 1224635 | 2/1960 | France . | |
| 2042955 | 2/1971 | France . | |
| 19872 | 9/1911 | United Kingdom | 418/61 R |
| 2142093 | 1/1985 | United Kingdom . | |

*Primary Examiner*—John J. Vrablik

*Attorney, Agent, or Firm*—Bell, Seltzer, Park & Gibson

[57] ABSTRACT

A gear pump is disclosed which is adapted to produce a large number of independent output streams, and which includes a housing having a cylindrical opening, a toothed gear disposed coaxially within the cylindrical opening, and at least one pinion gear disposed within the cylindrical opening and mounted in meshing engagement with the toothed gear. A plurality of enclosed fluid chambers are disposed in an equally spaced apart arrangement about the periphery of the toothed gear during orbital rotation of the pinion gear, which in one embodiment includes a tooth cover positioned forwardly of the pinion gear, and in another embodiment comprises the spaces between the teeth of the toothed gear. A fluid inlet is provided for delivering a fluid to the cylindrical opening and to each of the enclosed fluid chambers, and a fluid outlet having a one way valve also communicates with each of the fluid chambers. Thus in operation, the teeth of the pinion gear sequentially enter the enclosed fluid chambers, so as to compress the chamber and cause the fluid which has been delivered to the chamber to be expelled through the associated fluid outlet.

4 Claims, 7 Drawing Sheets

GEAR PUMP HAVING MULTIPLE OUTPUTS

This application is a divisional of application Ser. No. 701,638, filed Feb 14, 1985, now U.S. Pat. No. 4,674,964.

The present invention relates to a gear pump for producing a large number of independent output streams of a fluid, with all of the streams having substantially the same volume flow rate.

Textile processing machines, such as yarn false twisting machines, are typically composed of a large number of side by side stations which process an individual yarn. In such machines, it is often desirable to apply a small quantity of a fluid to the yarn being processed at each station, for the purpose of cooling, lubricating, or applying a finish to the yarn. Any difference between the individually applied quantities of the fluid may lead to nonuniformity of the properties of the several yarns, and thus to an inferior quality. This problem is particularly difficult when only a very small quantity of the fluid is to be applied at each working station. For example, the quantity may be adapted to the yarn weight passing through the station, and may be less than one percent. At any rate, it is less than 50% of the yarn weight. Heretofore, one pump has been positioned at each working station for metering the fluid onto the yarn. In addition to the constructional expense, the application of a uniform metered quantity depends upon an identical output from each of the pumps, which is difficult to achieve.

It has also been proposed to provide an aggregate stream of fluid from a single pump, with the output being throttled and then distributed to the individual working stations. However, this proposal has not achieved accurately metered individual streams.

Gear pumps of a variety of designs are presently known. Also, such pumps have been proposed which are designed to concurrently produce several identical volume streams. One such gear pump is disclosed in German Offenlegungsschrift No. 20 16 171, and corresponding British Pat. No. 1,297,002, which disclose a pump which includes a ring having internal gear teeth, with the ring being mounted for rotational movement in an annular groove formed in a fixed housing plate. The housing plate contains a number of cylindrical pockets distributed around the circumference of the annular groove, and pinion gears are supported within each of the pockets so as to mesh with the gear ring. One of the pinion gears is driven, which in turn drives the gear ring and the other pinion gears. Supply lines lead to the teeth leaving a meshing engagement, and discharge lines lead away from the teeth entering a meshing engagement. Thus, the mode of operation of this pump corresponds to that of other conventional pumps having two meshing gears. While the disclosed pump produces three identical streams, it is not realistically possible to supply a larger number of streams with a pump of this type. Further, a continuous flow of fluid is supplied to each discharge or user line.

Heretofore, gear pumps have not been able to supply a larger number of fluid streams with relatively small quantities of the fluid. While very accurate metering pumps are available, in which a piston and plunger are employed to determine the quantities, such pumps are very costly and susceptible to breakdown, particularly when the conveyed fluid has no lubricating properties. In addition, this type of pump does not as a practical matter permit the supply of a large number of individual streams.

It is accordingly an object of the present invention to provide a gear pump which is adapted to produce, at reasonable cost, a large number of individual streams of a fluid of substantially the same volume flow rate, and which does not require the use of additional metering devices.

These and other objects and advantages of the present invention are achieved in the embodiments illustrated herein by the provision of a gear pump which includes a housing having a cylindrical opening and which defines a central axis, a toothed gear disposed coaxially within the cylindrical opening, and at least one pinion gear disposed within the cylindrical opening and mounted in meshing engagement with the toothed gear so as to orbit about the central axis. A drive shaft is disposed along the central axis and is connected to the pinion gear mounting means for concurrent rotation therewith, and means are provided which define a plurality of enclosed fluid chambers disposed in an equally spaced apart arrangement about the periphery of the toothed gear during orbital rotation of the pinion gear. A fluid inlet is provided for delivering a fluid to the cylindrical opening and to each of the enclosed fluid chambers, and a fluid outlet having a one way valve also communicates with each of the fluid chambers. Thus in operation, the teeth of the pinion gear sequentially enter the fluid chambers, with at least one tooth of each gear acting to compress the chamber as it enters therein, causing the fluid which has been delivered to the chamber to be expelled through the associated fluid outlet.

In one embodiment of the invention, the fluid chambers are defined by a tooth cover which is positioned at the forward side of each pinion gear when viewed in its direction of orbiting rotation, with each tooth cover being mounted to the pinion gear mounting means and including a first surface portion immediately adjacent the addendum circle of the toothed gear, and a second surface portion immediately adjacent the addendum surface of the associated pinion gear. Thus in this embodiment, each of the fluid chambers is bounded by a selected number of teeth of the toothed gear, a selected number of teeth of the pinion gear, and the tooth cover.

In another embodiment, the enclosed fluid chambers are defined by a selected curvature of the flanks of the teeth of the toothed gear, and a selected curvature of the flanks of the teeth of each of the pinion gears, and such that an enclosed fluid chamber is formed in each of the spaces between adjacent teeth of the toothed gear upon a tooth of a pinion gear meshing therewith. Thus in this embodiment, each of the spaces between the teeth of the toothed gear comprises one of the enclosed fluid chambers, and a fluid outlet communciates with each of such spaces.

In certain of the embodiments of the present invention, the housing includes a housing plate having the cylindrical opening therethrough, and a pair of cover plates mounted on respective opposite sides of the housing plate. Also, the toothed gear is integrally formed in the cylindrical opening, and such that the inner edge of the cylindrical opening forms the addendum circle of the toothed gear. A rotor having a cylindrical outer edge is positioned within the cylindrical opening of the housing plate, and so as to be substantially free from play. The rotor is in the form of a plate and includes one or more cylindrical pockets disposed about its outer circumference, and which are preferably evenly distributed. The centers of these pockets are on a circle, the diameter of which is less than the diameter of the addendum circle of the internal teeth of the toothed gear. The rotor also includes an annular duct extending between the pockets, which is connected with the fluid inlet line, and the annular duct is provided with radial passages leading to the outer circumferential edge of the rotor. The fluid outlet ducts communicate with selected ones of the spaces between the teeth of the toothed gear, and as indicated above, each of the ducts includes a one way valve. In one specific embodiment, the outlet ducts communicate with the spaces adjacent the base circle of such teeth, and lead radially outwardly.

In a further specific embodiment of the present invention, the pinion gears are floatingly supported within their respective pockets of the rotor plate, and they are secured with a minimum play between the cover plates which are disposed on opposite sides of the housing plate.

A multiplication of the number of fluid outlets may be provided by a further embodiment of the invention, wherein the housing includes a plurality of housing plates, with the several housing plates being of identical construction. In particular, pockets are provided for the pinion gear in each rotor plate in the same number, but in a staggered arrangement such that they have the same angular separation from each other when viewed in a transverse or axial direction. The adjacent housing plates may be separated by an intermediate plate positioned therebetween, with the outside diameter of the intermediate plate being larger than the base circle of the teeth of the toothed gear. Thus, the internal toothed gears of adjacent housing plates are separated by the intermediate plate.

In certain other of the embodiments, the pinion gears are supported on journals. For this purpose, the housing may include a concentric bearing plate positioned on one side of the housing plate, to which the journals are attached. An additional plate may also be provided to reinforce the housing plate, with the additional plate having a cylindrical bore concentric to but with a larger diameter than the internal toothed gear, into which bore the bearing plate closely fits in both diameter and thickness. Thus the additional plate and bearing plate are coplanar.

The above embodiment permits a duplication or expansion of the number of outlets in the gear pump in a simple manner, in that the bearing plate may be placed between the two housing plates, together with an additional plate which is coplaner with the bearing plate. Similarly, it is possible to join identical assemblies, or assemblies which differ somewhat from each other, in the manner described above, and wherein the supported pinion gears are floatingly mounted in the manner described above.

The present invention also involves alternative possibilities for securing against the return flow of the pumped fluid. For this purpose, the bearing plate should have a diameter somewhat larger than the diameter of the base circle of the internal teeth of the toothed gear. However, rather than extending radially outwardly, the outlet ducts may extend in a parallel direction through the housing plate in an area outside the base circle, and so as to define openings on the front side of the housing plate which faces the bearing plate. The bearing plate has an outside diameter which clearly projects beyond these openings, and groove-shaped recesses are formed in the front side of the bearing plate facing the inlet openings of the outlet ducts. The groove-shaped recesses extend in a radial direction from the addendum circle of the teeth of the internal gear to a circle enclosing the inlet openings of the outlet ducts. Also, each recess extends in a circumferential direction across a sector angle which is less than the angular distance between the inlet openings of adjacent outlet ducts. The initial groove-shaped recess is positioned adjacent the corner of the associated pocket opening for the pinion gear which is located forwardly in the rotation direction of the rotor. Also, it is possible to permit the outlet ducts to extend radially, so as to communicate with the spaces of the internal teeth of the toothed gear. However, in the presently described embodiment, the outlet ducts extend from the front side of the housing plate which faces the bearing plate, so that the outlet duct first extends axially, and then radially outwardly.

In the pump embodiments having axially extending portions of the outlet ducts, the openings may be arranged on a circle on the front side of the housing plate which faces the bearing plate. The diameter of this circle is larger than the diameter of the base circle of the internal gear teeth by an amount equal to at least twice the diameter of the inlet openings. The radially extending recesses which are formed into the front side of the bearing plate extend from the circumference of the circle circumscribing the inlet openings into a circle which includes the addendum circles of the pinion gears. Also, these recesses preferably extend to the area of the pitch circle of the internal gear teeth. The position and number of recesses which are arranged side by side for each pinion gear, depends upon the nature of the enclosed fluid chamber, and specifically, the number of tooth spacings within each enclosed chamber. Further, the center lines of the recesses preferably extend in the plane passing through the central axis of the housing, and coincides with the plane of symmetry of the corresponding tooth spacings. For each pinion gear, up to a maximum of three recesses may be provided, in an arrangement which is defined by having the last recess, as seen in the rotational direction of the rotor, coincide with a line passing through the axis of the pinion gear and the central axis of the housing.

In the embodiments wherein the pinion gears rotate on parallel journals mounted to a bearing plate, the rotor may be omitted, or alternatively it may have an outside diameter which is considerably less than the addendum circle of the internal teeth. In such instances however, it is advantageous to provide each pinion gear with a tooth cover at its forward side as seen in the rotational direction. The tooth cover extends between the addendum circle of the pinion gear and the addendum circle of the internal teeth of the toothed gear, in the area of penetration of the pinion teeth. The tooth cover may be a part of the rotor, or in the absence of a rotor, it may be mounted to the bearing plate. The tooth cover should be so dimensioned that it overlaps one to one and one half tooth pitches, of both the internal gear teeth and the pinion gear.

In another embodiment, the gear pump is characterized in that the housing, which consist of one or more plates, is provided with a stationary, non-rotating external gear located in an open space within each housing plate, and which connects to the fluid inlet. The pinion gears are rotatably supported by a rotor, and so as to mesh with the external stationary gear. The teeth of the stationary gear and the pinion gears are so designed that the spaces between the adjacent teeth of the stationary gear form the enclosed fluid chambers during orbital rotation of the pinion gears. This may be accomplished in that the teeth mesh essentially without play, and that while engaged, both flanks of each tooth of the pinion gear are in constant contact with both flanks of the space between the teeth of the external gear.

Another embodiment of the gear teeth may be provided which includes an overlapping degree of two. In this embodiment, one of the pairs of cooperating flanks of the meshing gear teeth are in contact, while the other pair of opposing flanks are spaced from each other during meshing, with at least two successive pairs of teeth being in contact. Thus in this case, the enclosed chambers form an S or Z shaped cell. Since the tooth spacings of the stationary gear are closed on opposite sides by a housing cover or by the adjoining front side of the rotor, each tooth spacing of the stationary gear forms a metering enclosed fluid chamber, to which there is respectively associated an outlet duct.

The number of pinion gears rotating with the rotor and engaging the stationary gear may be one, or there may be as many as can be permitted by the overall dimensions of the housing. However, it has been found suitable that the number not exceed ten, and preferably comprises not more than six. At least two pinion gears are also preferred.

The stationary toothed gear may be a separate ring having internal gear teeth, which is positioned in a corresponding channel in the housing plate and secured against rotation. The internal teeth may also be integrally formed into the cylindrical wall of the opening in the housing plate. Alternatively, the stationary toothed gear may be an external gear as noted above, and in this latter instance, the housing plate includes a cylindrical opening having a diameter which corresponds at least to that of the circle described by the outer periphery of the pinion gears, but is preferably somewhat larger than such circle.

As indicated above, the pinion gears may rotate in the above described manner on journals, regardless of the type of the stationary toothed gear. Alternatively, the pinion gears may be floatably mounted in cylindrical pockets formed in the rotor.

The outlet ducts which intermittently receive the conveyed fluid, include a one way valve means for preventing the return flow of the fluid. This one way valve means may comprise ball-type non-return valves, or alternatively, it may comprise a slide valve arrangement. This latter embodiment is advantageous in that it better prevents the clogging of the valve. Also, in this latter embodiment, the inlet openings of the outlet ducts extend in an axial direction with respect to the rotor or housing axis.

In the embodiment of the pump having a stationary external toothed gear, the inlet openings of the outlet ducts are positioned in the housing cover which is located on one side of the housing plate. These inlet openings are positioned on a cirle, the diameter of which preferably lies between that of the base circle of the external teeth and the pitch circle of the external teeth. Also, the inlet openings face the tooth spacings. A valve disc is located between the stationary gear and the inlet openings to the outlet ducts, with the disc being operative as a slide. More particularly, the valve disc includes a valve opening for each pinion gear, with the opening being so arranged that it lies on the line extending between the rotor axis and the pinion gear axis. To improve the sealing of the assembly, the external gear, pinion gears and the valve plate, are all axially movable, and are axially biased by a spring toward the inside surface of the housing cover which includes the inlet openings.

Some of the objects and advantages of the present invention having been stated, others will appear as the description proceeds when taken in conjunction with the accompanying drawings, in which FIG. 1 is a sectional front elevation view of a gear pump embodying the features of the present invention;

Figure 1:
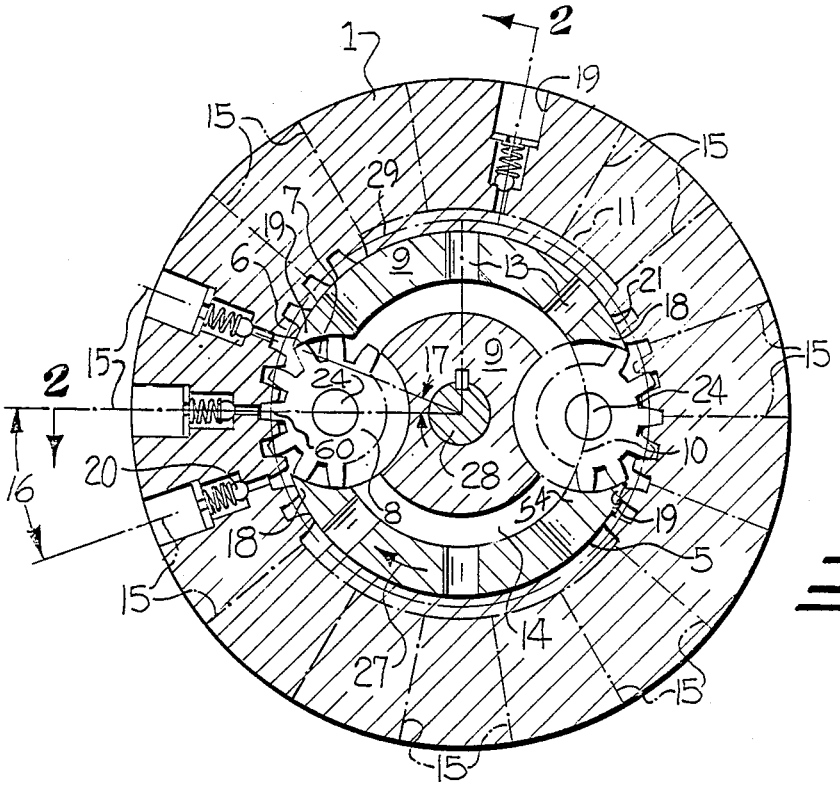

Referring more particularly to the drawings, several embodiments of a gear pump in accordance with the present invention are disclosed. In each of the disclosed embodiments, the pump comprises a housing composed of a flat housing plate 1, and two opposite housing covers 2 and 3 overlying respective opposite sides of the plate 1. In the embodiment of FIG. 1, the housing plate 1 has a cylindrical opening which defines a central axis extending therethrough, and with a drive shaft 28 extending coaxially along the central axis. A toothed internal gear 6 is disposed coaxially within the central opening, and which defines a base circle 11, a pitch circle 29, and an outer or addendum circle 5. The gear 6 is integrally formed in the cylindrical opening of the housing plate such that the inner edge of the cylindrical opening is coincident with the addendum circle of the toothed gear.

A plurality of pinion gears 8 are disposed within the cylindrical opening of the housing plate 1, and mounting means are provided for mounting each of the pinion gears in meshing engagement with the toothed gear 6 and for orbital rotation about the central axis in the direction 27. The pinion gear mounting means includes a rotor plate 9, the cylindrical outer surface 21 of which lies closely adjacent the addendum circle 5 of the toothed gear 6. By this arrangement, the outer surface 21 of the rotor plate 9 is located so as to be substantially free from play in the bore defined by the addendum circle 5.

The rotor plate 9 includes two cylindrical pockets 7 formed on opposite sides of the central axis, and the centers of the pockets are positioned on a circle 10 which is concentric to the rotor axis at a location so that the outer circumference of the rotor 9 is intersected by the pockets 7. Each pocket 7 thus defines corners 18 and 19, the spacing of which is a factor in considering the angular separation 16 of the adjacent outlet ducts 15 as described below. The pockets 7 mount pinion gears 8, which precisely fit within the same, and the gear teeth of the pinion gears mesh with the internal teeth of the gear 6, along that portion of the pinion gears which extends between the pocket openings 18 and 19. The pinion gears 8 are mounted so that the pitch circle tangentially contacts the pitch circle 29 of the toothed gear 6 to define a pitch point at 60. The corners 18 and 19 will be seen to be slightly rounded.

Figure 2:
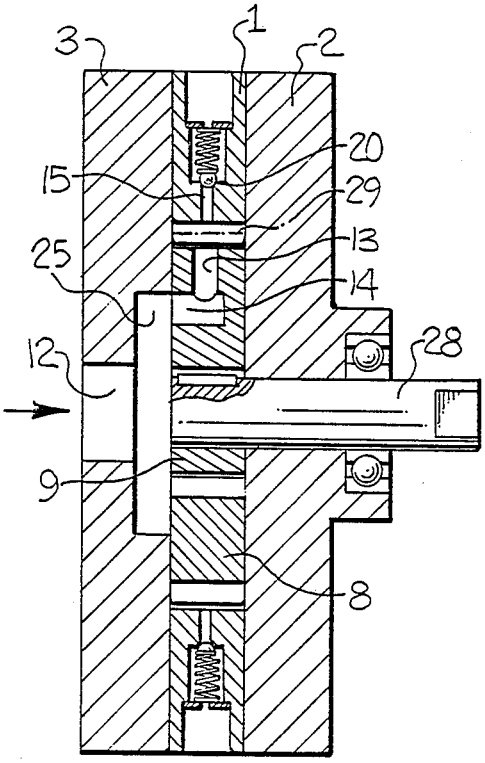
FIG. 2 is a sectional side elevation view of the apparatus shown in FIG. 1, and taken substantially along the line 2—2 of FIG. 1.

The housing plate 1, together with the rotor 9 and pinion gears 8 are enclosed between the two housing covers 2 and 3. The cover 2 serves as a bearing for the drive shaft 28 of the rotor 9 as best seen in FIG. 2, and the cover 3 contains an inlet 12 which serves as a fluid supply inlet for the fluid to be pumped. A distribution channel 25 is formed in the cover 3, which leads to an annular duct 14 formed in the rotor and which interconnects the pinion gear pockets 7. From the annular duct 14, radial passages 13 extend to the outer surface 21 of the rotor 9. Thus the fluid is adapted to fill the spacings between the teeth of the gear 6 between the adjacent pinion gears 8.

Figure 3:
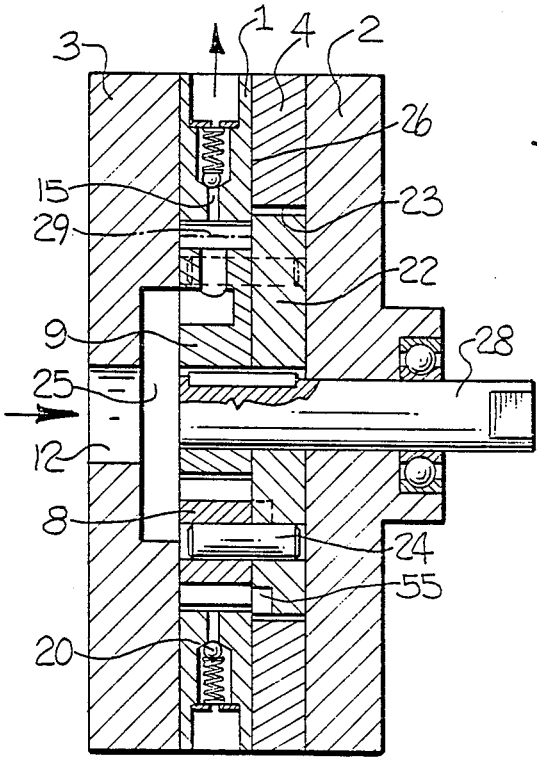
FIG. 3 is a view similar to FIG. 2, but illustrating an embodiment which includes a bearing plate for mounting the pinion gears.

The gear pump of the present invention further includes means defining a plurality of enclosed fluid chambers disposed in an equally spaced apart arrangement about the periphery of the toothed gear 6 during orbital rotation of each pinion gear 8, and such that each of the fluid chambers is compressed by at least one tooth of the pinion gear as the pinion gear enters such chamber. In the embodiment of FIGS. 1–3, the enclosed fluid chambers are defined in part by a tooth cover 54 which is formed by the portion of the rotor plate 9 adjacent the corner 19, i.e. the forward side of the pinion gear when viewed in the direction of orbital rotation of the pinion gear. The tooth cover 54 includes a first surface portion immediately adjacent the addendum circle 5 of the toothed gear 6 (which corresponds to a portion of the outer surface 21 of the rotor plate), and a second surface portion immediately adjacent to the addendum circle of the associated pinion gear (which corresponds to a portion of the surface of the circular opening 7). Thus each of the enclosed fluid chambers is bounded on one side by a selected number of teeth of the toothed gear which extend from the pitch point 60 at the intersection of the pitch circles to the corner 19. It is also bounded by a selected number of teeth of the pinion gear, and by the tooth cover 54. Each of the fluid chambers also defines an angular distance 17 about the central axis and which is measured from the pitch point 60 to the initial point at which the first surface portion is immediately adjacent the addendum circle of the toothed gear 6. Thus each enclosed chamber is formed in the somewhat triangular area between the outer gear 6, the orbiting pinion gear 8, and the tooth cover 54, and the tooth cover serves to prevent the backflow of the fluid during movement of the pinion gear into the chamber. More particularly, as the pinion gear advances into each enclosed chamber, the chamber will be compressed in size by the entering teeth of the pinion gear. An outlet duct 15 necessarily communicates with each of such enclosed chambers, and the angular separation 16 between the outlet ducts 15 should be generally dimensioned so that it corresponds to the angular distance 17. It will also be understood that the flanks of the meshing teeth of the toothed gear 6 and pinion gears 8 are configured so as to avoid sealing the fluid in the bottom of the spaces between the teeth of the toothed gear 6 upon entry of a mating tooth of the pinion gear 8. Each outlet duct 15 includes one-way valve means in the form of a spring biased ball valve 20, such that the fluid in each fluid chamber is expelled through the outlet duct 15, and back flow is precluded.

FIG. 3 is a sectional view of a somewhat modified embodiment of the gear pump of the present invention, and which further includes a bearing plate 22 which is disposed adjacent and parallel to one side of the rotor plate, and so as to overlie and cover one side of the cylindrical opening. In addition, the bearing plate 22 mounts a pair of parallel journals 24, for mounting respective ones of the pinion gears. In addition, the housing includes an additional plate 4 which contains a cylindrical opening 23, which is somewhat larger in diameter than the addendum circle 5 of the internal gear 6, and which accommodates the bearing plate 22.

As a further embodiment of the present invention the one way valve means associated with each outlet duct 15 may include a portion of the bearing plate 22. This embodiment is disclosed in FIGS. 7, 8, and 9, wherein the bearing plate 22 has a diameter which clearly projects beyond the base circle 11 of the internal gear 6. The outlet ducts 15 have an inner portion 43 which extends axially, so as to define an inlet opening 40 which is arranged in a circle 44 concentric to the internal gear 6 and which is larger than the base circle 11 by at least twice the diameter of the inlet openings. The inlet openings 40 are arranged on the front side 26 of the housing plate 1 facing the bearing plate 22. Formed into the front side of the bearing plate 22, and in the area of the pocket corners 18 and 19, are grooved-shaped recesses 39 which extend in a radial direction from the addendum circle 5 to a location beyond the openings of the outlet ducts 15. Also, the recesses 39 cover in the circumferential direction a sector angle which is less than the angular distance between the adjacent openings of the ducts 15. The recesses are aligned relative to the pinions, so that they extend in a side by side arrangement from the corner 18 or 19 which lies in front of the rotational direction 27, toward the other corner 18 or 19 of the same pocket opening.

Figure 7:
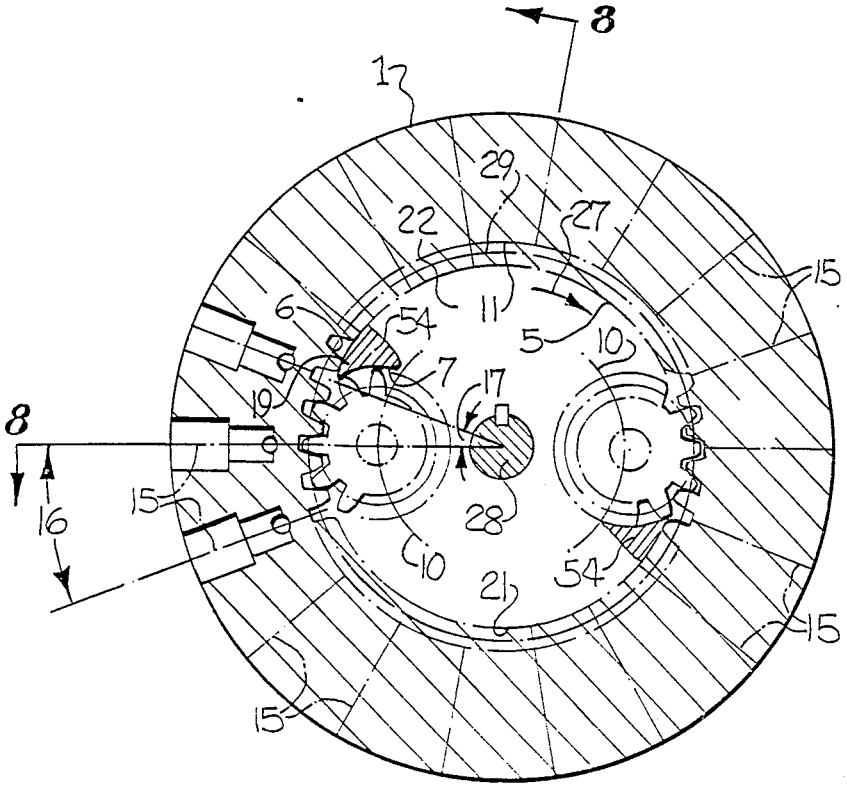
FIG. 7 is a view similar to FIG. 1, and illustrating still another embodiment and which includes a separate tooth cover.
Figure 8:
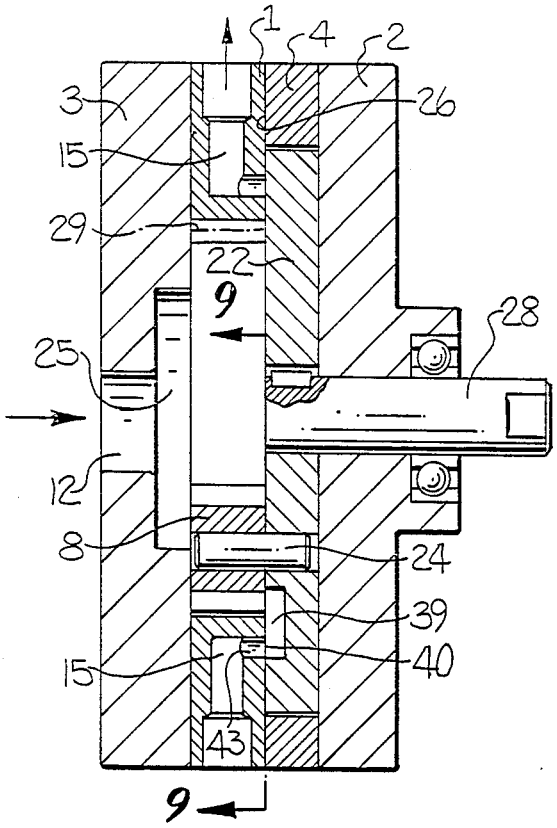
FIG. 8 is a sectional side elevation view taken substantially along the line 8—8 of FIG. 7.
Figure 9:
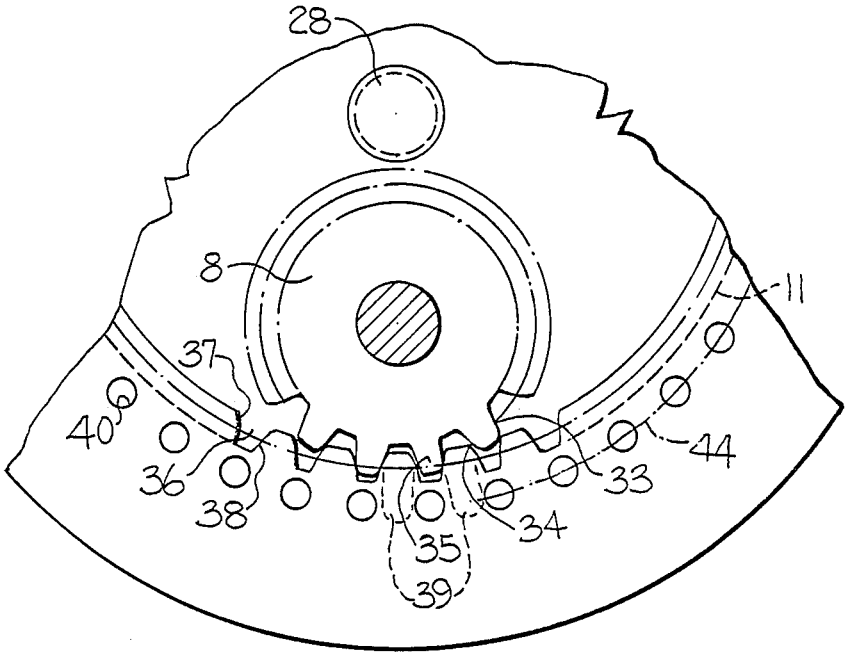
FIG. 9 is a fragmentary sectional front elevation view taken substantially along the line 9—9 of FIG. 8, but illustrating a slightly different embodiment from that of FIG. 7.

In the embodiments of FIGS. 7, 8, and 9, there is no rotor plate, and the space within the cylindrical opening of the housing plate 1 is open and unoccupied, except for the presence of the pinion gears 8. In addition, in FIG. 7 a separate tooth cover 54 is fixed to the bearing plate 22 and protrudes from the bearing plate into the cylindrical opening of the housing plate 1. More particularly, the tooth cover 54 has the same thickness as the pinion gears 8, which in turn corresponds to the thickness of the housing plate 1 and the toothed gear 6. The tooth cover 54 is structurally and functionally similar to that of the tooth cover described above with regard to the embodiment of FIGS. 1–3, and it has a first surface portion which is disposed immediately adjacent the addendum circle of the toothed gear 6, and a second surface portion which is immediately adjacent the addendum circle of the associated pinion gear. Each of the first and second surface portions of the gear cover has a length which extends along the addendum circle of the associated gear teeth a distance equal to at least one and one half times the pitch of such teeth. The embodiment of FIG. 9 differs from that of FIG. 7 in that there is no tooth cover 54. Rather, an enclosed fluid chamber is formed in each of the spaces between adjacent teeth of internal gear 6, and an outlet opening 40 and outlet duct 15 are provided for each each tooth space.

Figure 11:
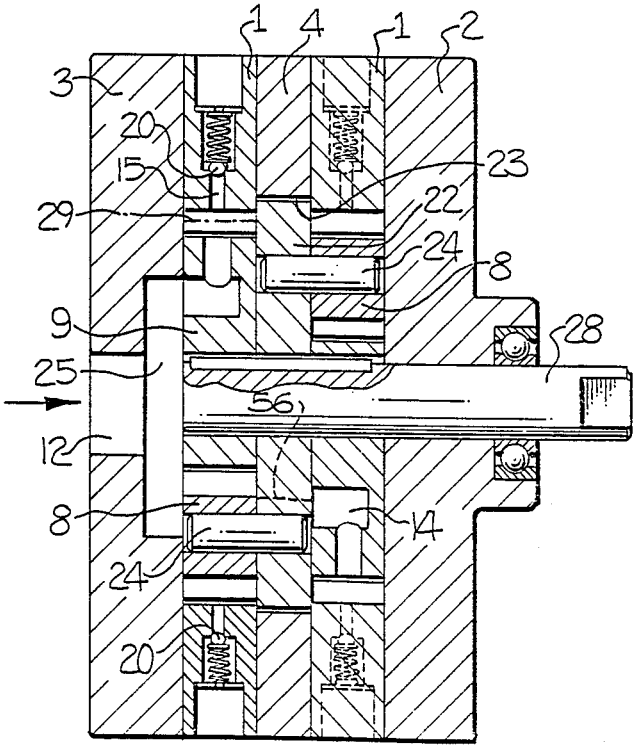
FIG. 11 is a sectional side elevation view of still another embodiment of the invention.

The heretofore described embodiments of the present invention readily lend themselves to enlargements, to the extend that two or more housing plates may be arranged side by side. Exemplary embodiments are disclosed in FIGS. 11 and 12. In the embodiment of FIG. 11, there are provided two housing plates 1, cover plates 2 and 3 disposed on the outside of the two plates 1, and an intermediate plate 4 disposed between the two plates 1. The shaft 28 is rotatably mounted within the front cover plate 2, and a fluid inlet 12 is in the cover plate 3. A rotor 9 is fixedly mounted to the shaft 28 within each of the housing plates 1, and an intermediate bearing plate 22 is fixed to the shaft 28 and is coplaner with the intermediate plate 4. Pinion gears 8 are freely rotatably mounted on the journals 24, so as to mesh with the teeth of the internal gear 6 of each of the housing plates 1. The diameter of the intermediate bearing plate 22 may be greater than the diameter of the base circle of the teeth of the gears 6, so as to cover the spaces between these teeth. The diameter of the inner cylindrical edge of the intermediate plate 4 is slightly greater than that of the base circle of the teeth, so that a channel is formed between the two plates 1 which receives the bearing plate 22. However, it is also possible to cover these spaces by the intermediate plate 4. The shape of the rotors and the pinion gears is the same as shown in the above embodiments, for example FIGS. 1 and 7. A bore 56 as shown in dotted lines extends through the bearing plate 22 for connecting the grooves 14 of the two rotors with a supply of fluid from the fluid inlet 12 to the other side. By the arrangement shown in FIG. 11, the number of fluid streams may be doubled as compared to the prior embodiments.

Figure 12:
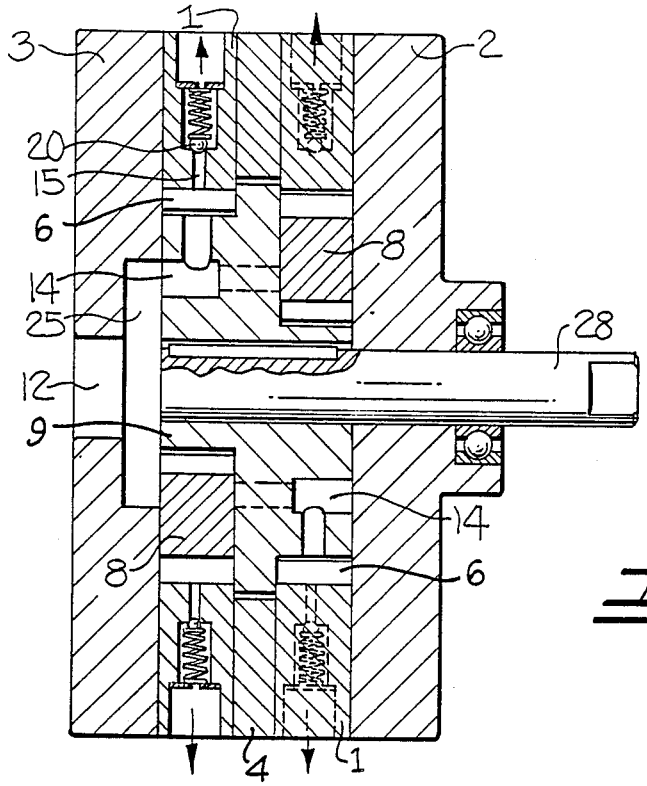
FIG. 12 is a sectional side view of a further embodiment of the invention.

In the embodiment of FIG. 12, the housing also comprises two housing plates 1, an intermediate plate 4, and two cover plates 2 and 3. In this case however, there is only one rotor 9, on opposite sides of which are formed pockets for receiving the pinion gears 8 so as to be in meshing engagement with the teeth of the gears 6 of the housing plates 1. In all other respects, this pump corresponds to that shown in the embodiment of FIG. 11.

Figure 4:
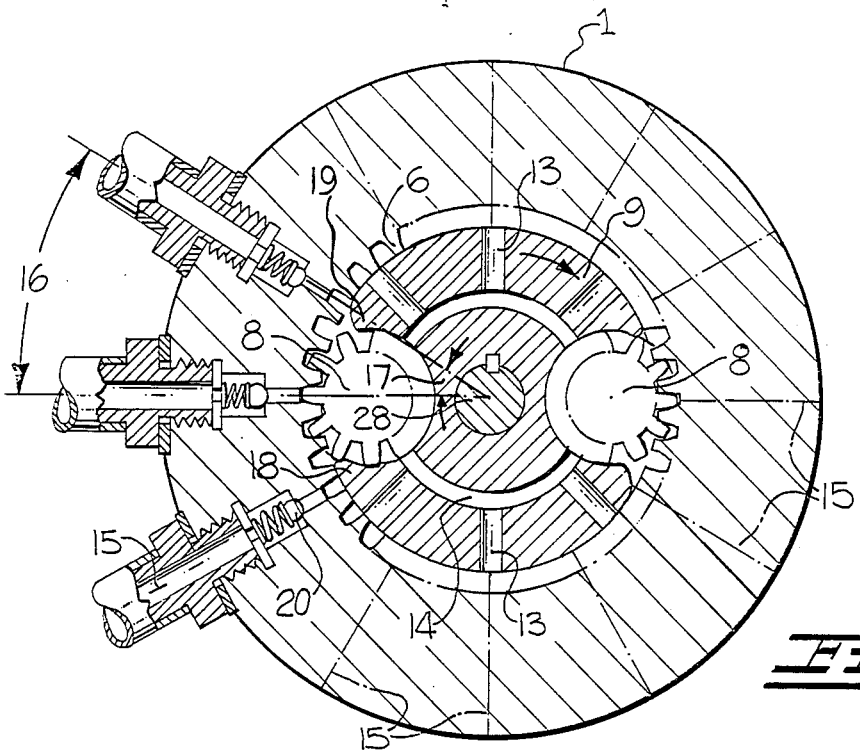
FIG. 4 is a view similar to FIG. 1, but illustrating a different embodiment of the rotor plate.

Referring now to the embodiment of FIG. 4, the pocket openings in the outer surface of the rotor are enlarged, in that a portion of the sharp corners of the rotor is removed. Thus the front portion of the tooth cover 54 is withdrawn somewhat from the teeth of the gear 6 and pinion gear 8, causing the enclosed fluid chamber in front of the pinion gear to be somewhat enlarged as compared to the embodiment of FIG. 1. Thus the angular distance 17 of the enclosed chamber, and which is measured from the pitch point at which the pitch circles tangentially contact each other to the initial point at which the gear cover 54 touches the addendum circle of the gear 6, also is enlarged. Also, the shape of the gear cover 54 may thereby be designed so as to adapt the size of the enclosed chambers to the angular spacing of the outlet ducts 15.

Figure 13:
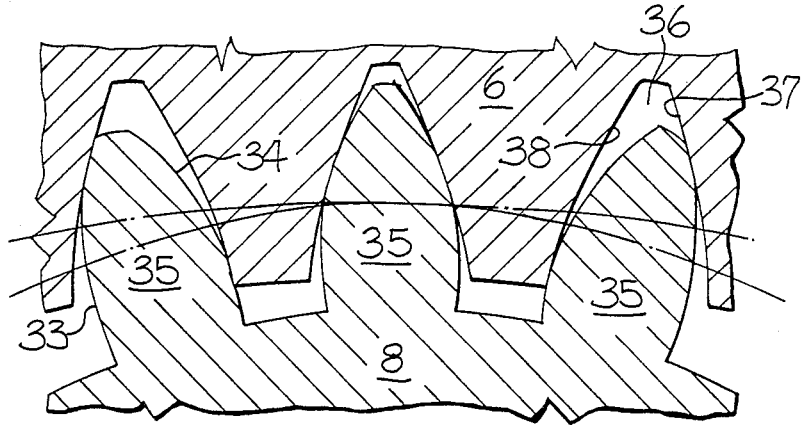
FIG. 13 is a fragmentary sectional view of one embodiment of the construction of the meshing teeth of the internal gear and pinion gear of the present invention.
Figure 14:
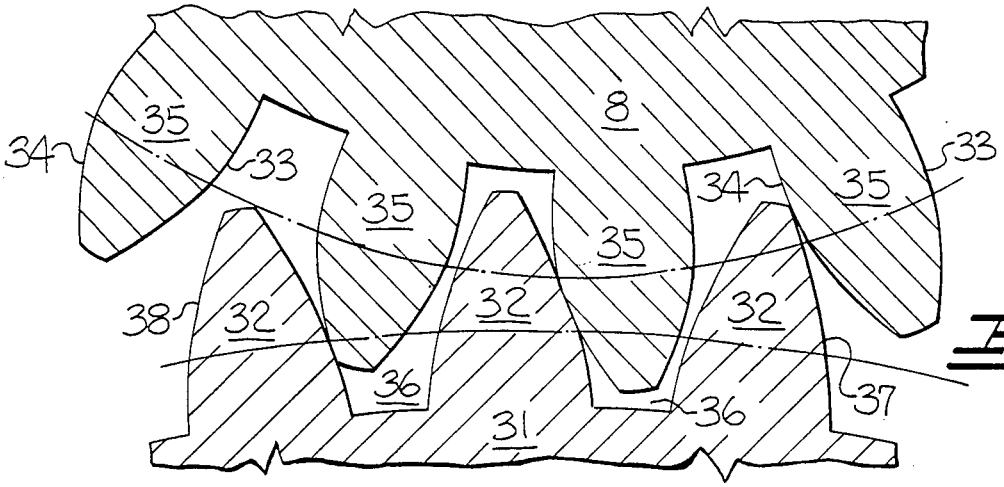
FIG. 14 is a fragmentary sectional view of another embodiment of the meshing gear teeth adapted for use with the present invention.

A relief groove may also be provided in the bearing plate 22, as shown at 55 in FIG. 3. This relief groove is desirable where the teeth are designed as shown in FIGS. 13 and 14 as described below, and wherein the two opposing teeth form a compression chamber which is separated from the enclosed chamber extending to the tip of the gear cover 54. In this event, it is advantageous to have a relief groove which connects these separated chambers, since only the enclosed chambers are in permanent communication with one of the outlet ducts. The relief groove 55 communicates with the bottom of the spaces between the teeth of the pinion gear 8, and extends in the circumferential direction from about the line connecting the centers of the rotor 9 and pinion gear 8 over a sufficient number of teeth such that the groove is in constant communication with the enclosed chamber. The relief groove may also be necessary where there is little flank clearance, to relieve the pressure in the spacings between the teeth of the pinion gear 8.

In the embodiments wherein the enclosed fluid chamber is defined in part by a tooth cover 54, it is desirable that the relief groove 55 also communicate with the bottoms of the teeth of the gear 6, which otherwise would have no communication to the outlet duct 15 and no opportunity to release the enclosed fluid.

Figure 5:
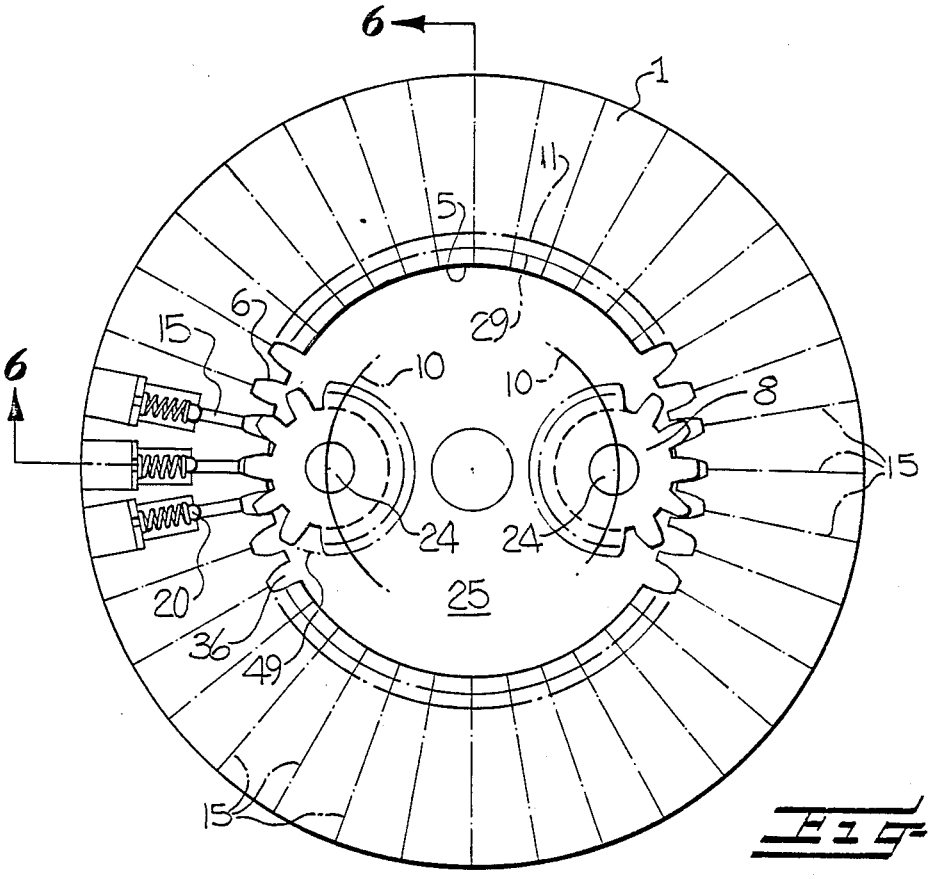
FIG. 5 is a view similar to FIG. 1, and illustrating still another embodiment which does not include a rotor plate.
Figure 6:
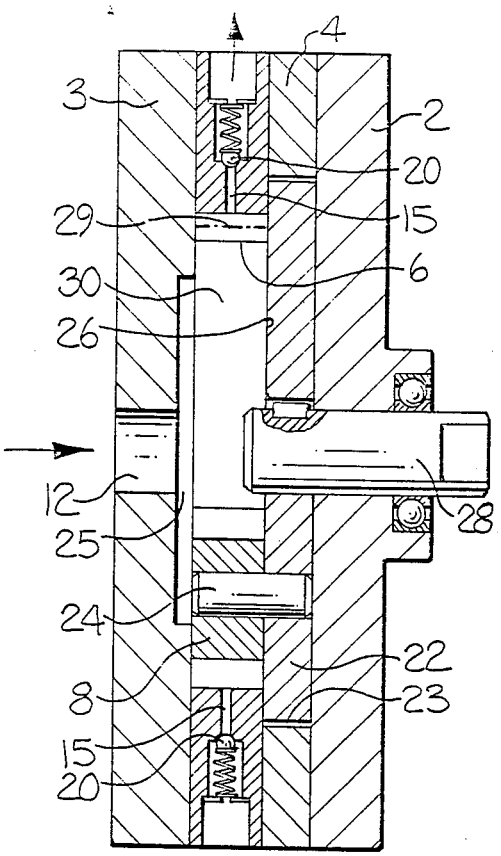
FIG. 6 is a sectional side elevation view taken substantially along the line 6—6 of FIG. 5.

FIGS. 5 and 6 illustrate still another embodiment of the present invention, wherein the means for mounting the pinion gears includes the bearing plate 22, with the bearing plate mounting a journal 24 for each of the pinion gears, and wherein the space within the inner edge of the cylindrical opening of the housing plate 1 is otherwise unoccupied and forms a portion of the fluid inlet means. Further, the outlet ducts 15 proceed from the base circle 11 of each of the gear teeth 6, i.e. from the bottom of the tooth spacings 36, and the ducts extend radially outwardly to the outer cylindrical surface of the housing plate 1. In this embodiment, an enclosed fluid chamber is formed in each of the spaces 36 between adjacent teeth of the gear 6 upon a tooth of a pinion gear 8 meshing therewith. More particularly, the curvature of the flanks of the teeth of the meshing gears are configured so as to define the enclosed fluid chambers, and as specifically described below with reference to FIGS. 13 and 14. The housing of this embodiment further includes an additional plate 4 having a cylindrical bore 23 of a diameter which is larger than the daameter of the base circle of the gear 6. The bearing plate 22 rotates within the bore 23, and the bearing plate 22 is in turn mounted on the drive shaft 28 so as to concurrently rotate the bearing plate 22 and the pinion gears 8 about the central axis.

The cover plate 3 of the embodiment shown in FIGS. 5 and 6 includes a cylindrical distribution channel 25, the outside diameter of which overlaps at least a portion of the pinion gears 8. During operation, the entire interior open space 30 is filled with the fluid being pumped.

Figure 5A:
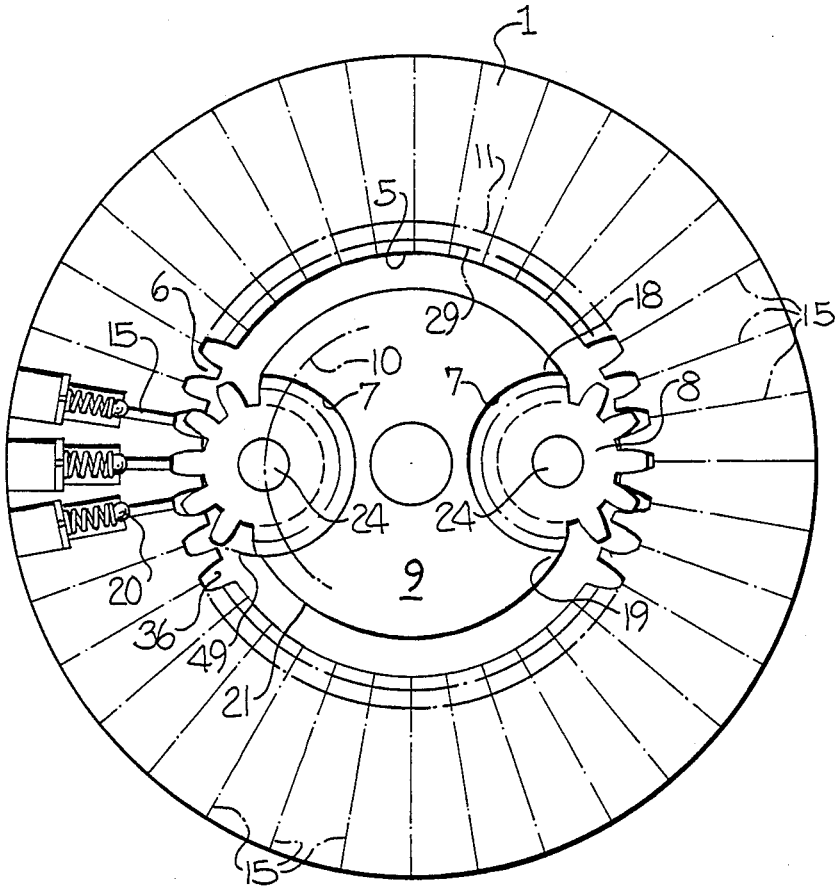
FIG. 5A is a view similar to FIG. 1, and illustrating a further embodiment of the invention.

As a further modification of the embodiment shown in FIG. 5, and as shown in FIG. 5A, the bearing plate 22 may mount a rotor 9 which projects into the interior 30 of the pump, with the cylindrical external surface 21 thereof having a diameter which is substantially less than the addendum circle 5 of the gear teeth 6. The thickness of the rotor is substantially the same as that of the housing plate 1, and is smaller only to the extent necessary to provide a running clearance between itself and the housing cover 3. Cylindrical pockets 7 are formed in the rotor 9, the diameters of which are adapted to that of the addendum circle 49 of the pinion gears. The pockets 7 communicate with the circular outer surface 21 of the rotor, and each pocket accommodates one of the pinion gears 8 in a floatingly supported arrangement. Also, the diameter of the rotor 9 should preferably be greater than that of the recess 25. With the illustrated arrangement of the outlet ducts 15, the additional plate 4 may be eliminated, with the housing being held together by suitable bolts (not shown) extending between the covers 2 and 3 and the housing plate 1.

Figure 10:
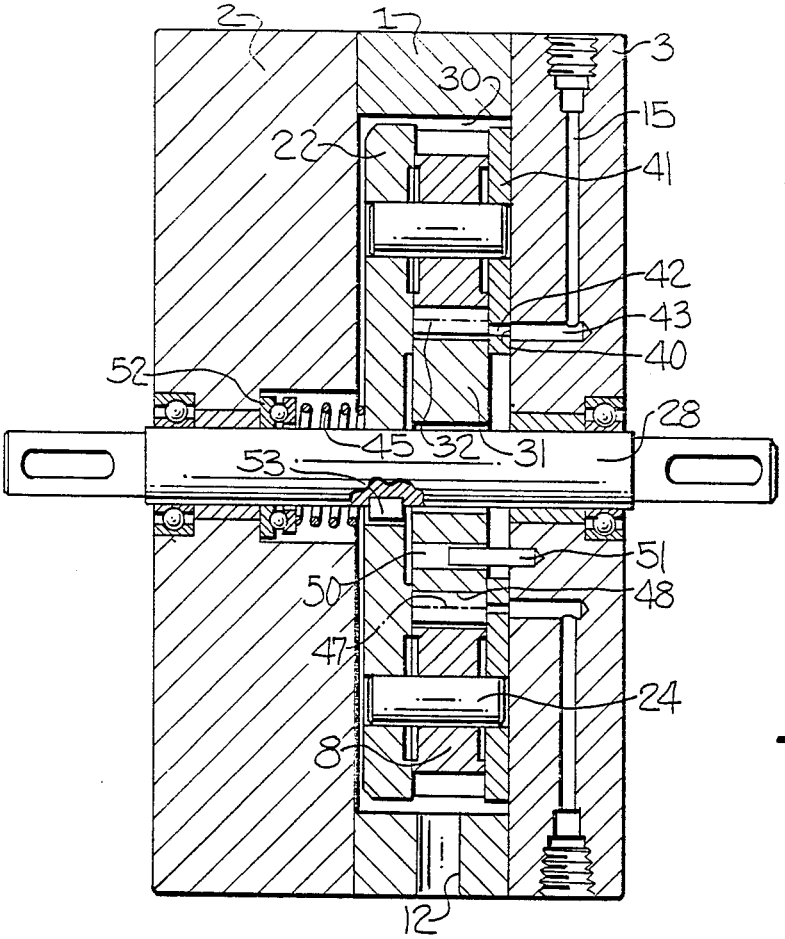
FIG. 10 is a sectional side elevation view of a further embodiment of the present invention.

Still another advantageous embodiment of the present invention is illustrated in FIG. 10. In this embodiment, the housing plate 1 is in the form of a ring, having a smooth cylindrical inner bore which defines an interior 30. A bearing plate 22 carrying the journals 24 for the pinion gears 8 is mounted on the drive shaft 28 and is adapted to be axially displaced with respect to the shaft 28. A biasing spring 45 acts to press the plate 22 toward the right as seen in FIG. 10. In addition, a stationary external gear 31 is fixedly mounted with respect to the housing, by means of the bores 50 which are distributed over its circumference, and the cooperating locking pins 51 which extend from the bores 50 into the housing cover 3. Each of the pinion gears is mounted between the external gear 31 and the cylindrical inner edge of the opening in the housing plate 1.

Between the stationary gear 31 and pinion gears 8 on the one hand, and the inside wall of the housing cover 3 on the other hand, there is provided a valve plate 41 which rotates together with the bearing plate 22 and the pinion gears 8. The valve plate 41 includes a valve opening 42 which lies along a straight line extending between the central axis and the respective pinion gear axis. The distance of the opening 42 from the central axis is determined such that the openings 42 extend at a point aligned with the teeth between the pitch circle 47 and base circle 48 of the external gear 31.

In the embodiment of FIG. 10, the outlet ducts for the pumped fluid are accommodated in the housing cover 3. In particular, the outlet ducts proceed from inlet openings 40 which are arranged in the side of the housing cover 3 facing the valve plate 41, and which form a circle which is coaxial to the bearing plate 22. The openings 40 are arranged opposite the external teeth 32 with the diameter of the circle ranging between that of the base circle 48 and the pitch circle 47 of the external teeth 32. The openings extend axially through the portion 43 to the center of the housing cover 3, and from there radially outwardly. To minimize leakage when the pumped fluid is transferred from the spacings 36 through the valve opening 42 and into the inlets 40 of the outlet ducts 15, the bearing plate 22, pinion gears 8, stationary gear 31 and valve plate 41 are all axially displaced relative to the housing 1 in an axial direction by the spring 45. The spring 45 is supported at one end by a bearing 52. It will also be noted that the journals 24 which mount the pinion gears 8 are dimensioned so that they extend into corresponding bores of the valve plate 41, and thus connect the valve plate 41 for concurrent rotation with the bearing plate 22. In addition, the width of the opening 42 in the valve plate corresponds essentially to that of the tooth spacings so that the adjacent teeth are not overlapped. Further the housing plate 1 includes a radial fluid inlet opening 12 for delivering the fluid to be pumped into the open interior 30, and thus to the teeth 32.

As indicated above, the gear pump of the present invention is particularly suitable for intermittently supplying a large number of similar users. During each rotation of the rotor 9 or bearing plate 22, each of these users is supplied with a constant volume flow rate of fluid, as many times as there are pinion gears 8 present on the circumference of the stationary gear. In the embodiments of FIGS. 5–6 and 10, it is necessary for a satisfactory operation that the flanks of the teeth of the toothed gear and the flanks of the teeth of each of the pinion gears are so configured that, as soon as the pinion tooth 35 moves into the tooth spacing 36 of the stationary gear, the tooth spacing 36, which is filled with the fluid from the interior space 30, is sealed to form an enclosed fluid chamber. The enclosed fluid can thus only escape into and through the outlet ducts 15, and an outlet duct is necessarily associated with each space 36 of the stationary gear.

FIGS. 13 and 14 show two possible constructions for teeth which meet the above requirements. In both of these embodiments, the enclosed fluid chambers are defined by a selected curvature of the flanks of the teeth of the fixed toothed gear and a selected curvature of the flanks of the teeth of each of the pinion gears 8, and such that an enclosed fluid chamber is formed in each of the spaces between adjacent teeth of the toothed gear upon a tooth of the pinion gear meshing therewith.

In the embodiment of FIG. 13, an internal toothed gear 6 and a pinion gear 8 are shown in meshing engagement, and it will be seen that the curvature of the flanks 37, 38 of the teeth of the toothed gear 6 and the curvature of the flanks 33, 34 of the teeth 35 of the pinion gear 8 are configured so that within each of the spaces 36 between the teeth of the toothed gear 6, each of the two opposing pairs of flanks contact each other during meshing. In other words, the flanks 34, 37 contact each other, and the flanks 33, 38 contact each other. This contact is essentially free from play, and, considering the viscosity of the fluid being pumped, forms a seal therebetween. Thus during the course of an engagement, each tooth space 36 forms an enclosed fluid chamber which is compressed to pump the enclosed fluid through the outlet.

In the tooth construction of FIG. 14, there is illustrated a stationary external gear 31 having external teeth 32, and a pinion gear 8 meshing therewith. In this embodiment, the curvature of the flanks 37, 38 of the teeth 32 of the gear 31 and the curvature of the flanks 33, 34 of the teeth 35 of the gear 8 are configured so that within each of the spaces 36 between the teeth 32 of the gear 31, one opposing pair of flanks 34, 37 contact each other and the other opposing pair of flanks 33, 38 are spaced from each other during meshing. Thus each enclosed chamber has an S or Z shaped outline in cross section.

In the drawings and specification, there has been set forth a preferred embodiment of the invention, and although specific terms are employed, they are used in a generic and descriptive sense only, and not for purposes of limitation.

That which is claimed is:

1. A gear pump adapted to produce a large number of independent streams of fluid of substantially the same volume flow rate, and comprising a housing having at least one generally flat side and a cylindrical opening which defines a central axis extending substantially perpendicular to said one side of said housing, a toothed internal gear disposed coaxially within said cylindrical opening of said housing and fixedly mounted with respect thereto, and with said cylindrical opening coinciding with the addendum circle of said toothed gear, at least one pinion gear disposed within said cylindrical opening, pinion gear mounting means mounting each of said pinion gears in meshing engagement with said toothed gear and for orbital rotation about said central axis, and comprising a bearing plate disposed adjacent and parallel to said one side of said housing so as to overlie and cover said cylindrical opening, with said bearing plate mounting a journal for each of said pinion gears, drive shaft means disposed along said central axis and connected to said pinion gear mounting means for concurrent rotation therewith, means defining a plurality of enclosed fluid chambers disposed in an equally spaced apart arrangement about the periphery of said toothed gear during orbital rotation of each pinion gear, and such that each of the fluid chambers is compressed by at least one tooth of the pinion gear as the pinion gear enters such chamber, fluid inlet means for delivering a fluid to said cylindrical opening and to each of said enclosed fluid chambers, and fluid outlet means communicating with each of said fluid chambers, said fluid outlet means including a plurality of radially extending and circumferentially spaced part outlet ducts in said housing, with each of said outlet ducts including an outlet opening communicating with said one side of said housing, with said openings being arranged in a circle about said central axis, and at least one recess associated with each pinion gear and formed in the face of said bearing plate which opposes said one side of said housing, and so as to extend radially between the spaces formed between the teeth of said toothed gear and said circle of outlet openings, and such that the fluid delivered to each fluid chamber is expelled through said fluid outlet means by the teeth of the orbiting pinion gear entering such chamber.

2. The gear pump as defined in claim 1 wherein said means defining a plurality of enclosed fluid chambers includes a tooth cover associated with each pinion gear, with each tooth cover being mounted to said pinion gear mounting means and including a first surface portion immediately adjacent the addendum circle of said toothed gear and a second surface portion immediately adjacent the addendum circle of the associated pinion gear, and such that each of the fluid chambers is bounded by a selected number of teeth of the toothed gear, a selected number of teeth of the pinion gear, and said tooth cover.

3. The gear pump as defined in claim 1 wherein said means defining a plurality of enclosed fluid chambers comprises a selected curvature of the flanks of the teeth of said toothed gear and a selected curvature of the flanks of the teeth of said pinion gears, such that an enclosed fluid chamber is formed in each of the spaces between adjacent teeth of said toothed gear upon a tooth of a pinion gear meshing therewith, and wherein said fluid outlet means includes one of said outlet openings associated with each of said spaces.

4. The gear pump as defined in claim 1 wherein each of said outlet ducts of said fluid outlet means includes one-way valve means.

* * * * *